US007607793B2

(12) United States Patent
Coushaine et al.

(10) Patent No.: US 7,607,793 B2
(45) Date of Patent: Oct. 27, 2009

(54) DECORATIVE LIGHT TILE

(75) Inventors: Charles Coushaine, Rindge, NH (US); Frank St. Onge, Newburyport, MA (US); Thomas Tessnow, Weare, NH (US)

(73) Assignee: OSRAM SYLVANIA Inc., Danvers, MA (US)

( * ) Notice: Subject to any disclaimer, the term of this patent is extended or adjusted under 35 U.S.C. 154(b) by 170 days.

(21) Appl. No.: 11/831,310

(22) Filed: Jul. 31, 2007

(65) Prior Publication Data

US 2009/0034241 A1 Feb. 5, 2009

(51) Int. Cl.
*F21S 8/00* (2006.01)

(52) U.S. Cl. ..... 362/145; 362/153.1; 362/600; 362/609

(58) Field of Classification Search ..... 362/84, 362/145, 153, 153.1, 362
See application file for complete search history.

(56) References Cited

U.S. PATENT DOCUMENTS

| | | | | |
|---|---|---|---|---|
| 6,755,550 | B1 * | 6/2004 | Lackey | 362/147 |
| 6,958,182 | B2 * | 10/2005 | Hasecke et al. | 428/67 |
| 7,108,392 | B2 | 9/2006 | Strip et al. | |
| 7,494,258 | B2 * | 2/2009 | McNaught | 362/554 |
| 7,549,784 | B1 * | 6/2009 | Teeters | 362/576 |
| 2004/0080938 | A1 | 4/2004 | Holman et al. | |
| 2005/0116667 | A1 | 6/2005 | Mueller et al. | |
| 2005/0219860 | A1 | 10/2005 | Schexnaider | |
| 2007/0047228 | A1 | 3/2007 | Thompson et al. | |
| 2007/0147036 | A1 | 6/2007 | Sakai et al. | |
| 2008/0019121 | A1 * | 1/2008 | Ly | 362/145 |
| 2008/0037284 | A1 * | 2/2008 | Rudisill | 362/629 |
| 2009/0116241 | A1 * | 5/2009 | Ashoff et al. | 362/253 |

OTHER PUBLICATIONS

Unknown, "Mood Ligt by OSRAM," Product Summary, 2007, 30 pages, Traxon Technologies, USA.
Unknown, "Welcome to the World of Luminaires," BL L Newsletter, No. 2, Apr. 2007, 17 pages, OSRAM GmbH, Germany.
Unknown, "Lightwild," printed from http://www.lightwild.com/products/tilesandblocks_floortiles.asp, 1 page, 2005, LightWild, USA.
International Search Report and Written Opinion for PCT/US 08/08907 dated Oct. 9, 2008.

* cited by examiner

*Primary Examiner*—Ali Alavi
(74) *Attorney, Agent, or Firm*—Edward S. Podszus

(57) ABSTRACT

A decorative light tile includes a base, a light source adjacent to the perimeter of the base positioned to illuminate at least a slanted light reflecting area of the base, and a cover mounted on the base adapted to be illuminated by light from the light source reflected off the slanted light reflecting area. Additionally, the light tile includes a bus bar system. The bus bar system includes positioned along a perimeter of the light tile. The bus bar system is electrically connected to the light source and provides a circuit for supplying power to the light source. A light tile system includes a plurality of light tiles, a decorative sheet positioned adjacent to each light tile and illuminated by the light source within the light tile, and a power supply. Each light tile includes a bus bar system connected to a light source within the light tile and the light tiles may be positioned contiguous to each other so that the bus bar systems are in electrical contact with each other.

32 Claims, 12 Drawing Sheets

DECORATIVE LIGHT TILE

BACKGROUND

Many homeowners like to be creative in decorating the inside of their homes. One way people make their homes distinctive is with wall hangings. Typically, wall hangings consist of static pictures, photographs or other non-changing memorabilia. Often, wall hangings are expensive and not attractively lit from within. Furthermore, most wall hangings cannot easily be reconfigured and customized for the changing seasons or to coordinate with changing home decor.

SUMMARY

Embodiments of the invention include a light tile, a bus bar system and a light tile system. In an embodiment, the invention includes a light tile comprising a base, a light source adjacent to the perimeter of the base positioned to illuminate a slanted light reflecting area of the base, and a cover mounted on the base adapted to be illuminated by light from the light source reflected off the slanted light reflecting area. The base includes a rear surface and a front surface. The front surface includes a peripheral area adjacent to an outer perimeter of the base, an apex elevated in relation to the peripheral area, and a slanted light reflecting area between the peripheral area and the apex.

In another embodiment, the light tile includes a bus bar system. The bus bar system includes a bus bar system positioned along a perimeter of the light tile. The bus bar system is electrically connected to a light source and provides a circuit for supplying power to the light source. The bus bar system comprises a positive bus bar and a negative bus bar, the positive and negative bus bars being positioned at different elevations along the sides of the light tile.

Alternatively, the bus bar system comprises a flex circuit system positioned along a perimeter of the light tile. The flex circuit system is electrically connected to the one or more light sources and provides a circuit for supplying power to the light source(s).

In another embodiment, a light tile system comprises a plurality of light tiles, a decorative sheet positioned adjacent to each light tile and illuminated by the light source within the light tile, and a power supply. Each light tile includes a bus bar system connected to a light source within the light tile so that the light tiles may be positioned contiguous to each other with the bus bar systems in electrical contact with each other. The power supply includes a power bus connected to the bus bar system of one of the light tiles for supplying power to the light tiles.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
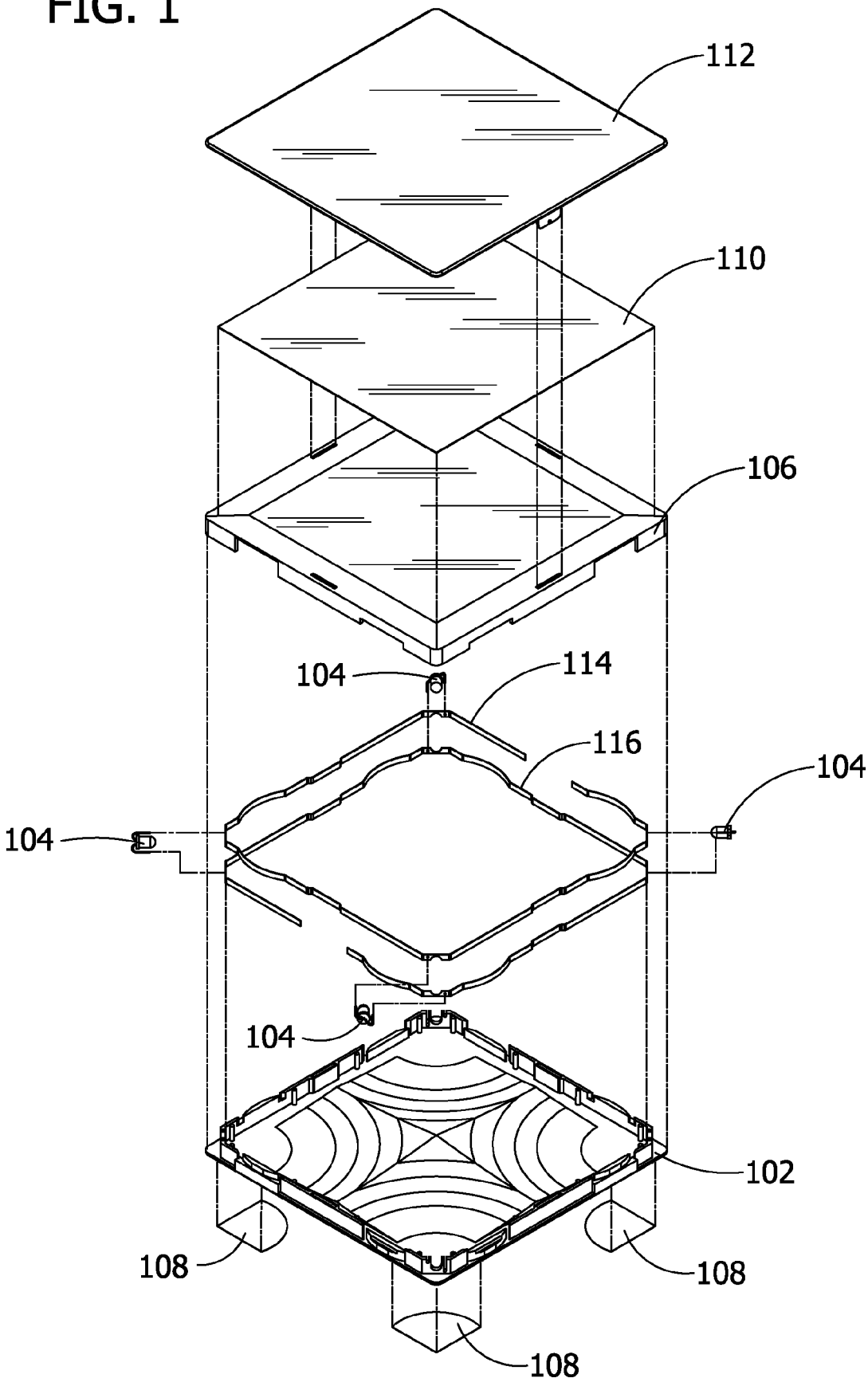
FIG. 1 is an exploded view of an exemplary embodiment of a light tile of the invention.

One embodiment of a light tile of the invention, as illustrated in FIG. 1, comprises a base 102, at least one light source 104 adjacent to the perimeter of the base 102, and a cover 106 mounted on the base 102. The cover 106 is translucent and may be manufactured from a clear plastic such as polycarbonate. In one embodiment, the light tile is approximately 15.24 centimeters (six inches) square and approximately 1.27 centimeters (one-half inch) deep.

Figure 2:
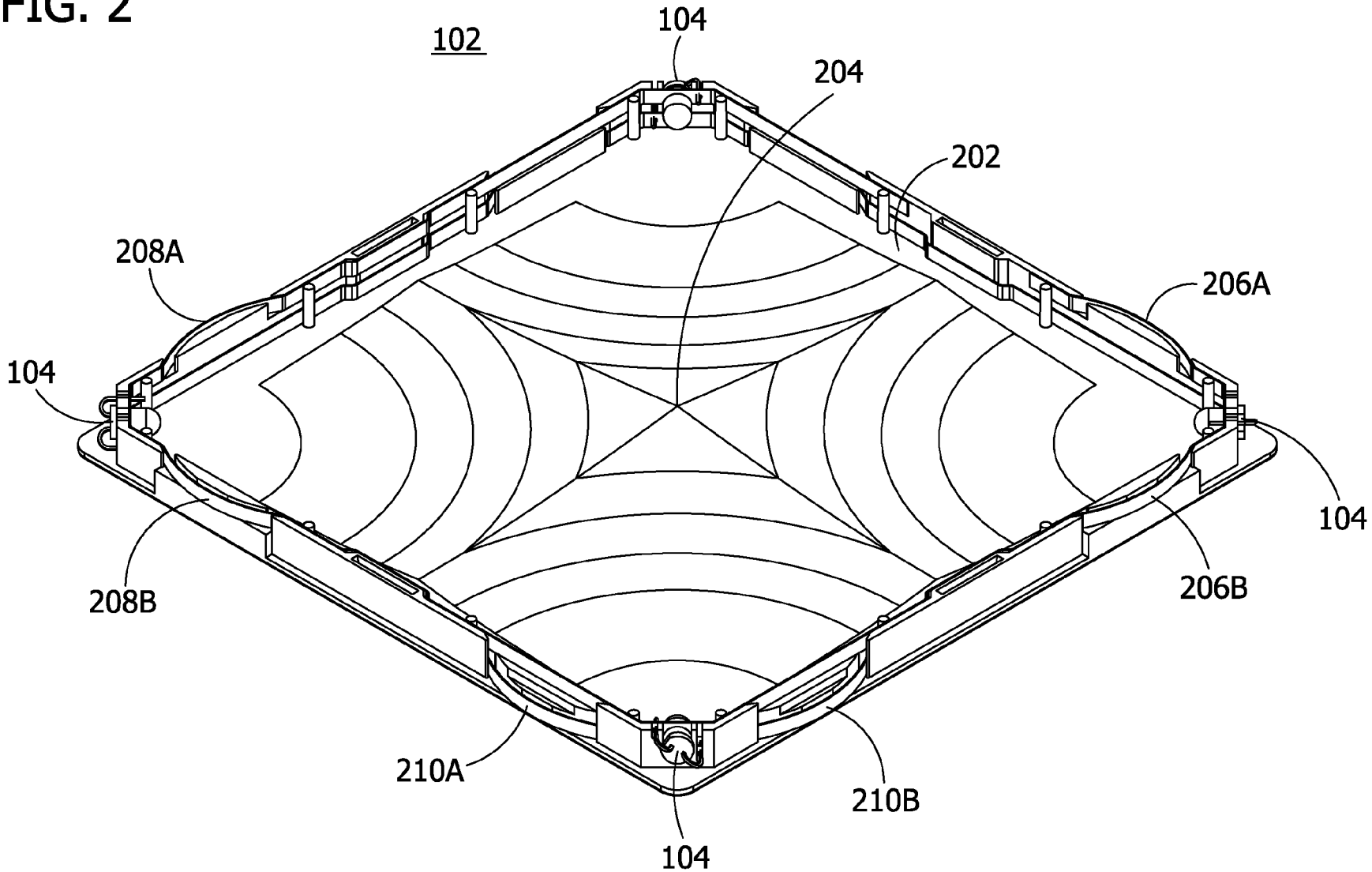
FIG. 2 is a perspective view illustrating an embodiment of a base of a light tile of the invention.

The base 102 comprises a rear surface adapted to be placed on a support surface and a front surface. The front surface, shown in detail in FIG. 2, comprises a peripheral area 202 adjacent to an outer perimeter of the base 102, an apex 204 elevated in relation to the peripheral area 202, and a slanted light reflecting surface area continuously transitioning between the peripheral area 202 and the apex 204. The slanted light reflecting area is a curved, sloped and/or inclined surface between the peripheral area 202 and the apex 204. In an embodiment, the light tile is rectangular and the light source 104 comprises four light sources positioned near respective corners of the slanted light reflecting area as shown in FIG. 2. The light source 104 is positioned to illuminate at least the slanted light reflecting surface area of the base 102. The apex 204 is located generally at the center of the base 102 and the slanted light reflecting surface area surrounds the apex 204 and forms a plurality of regions surrounding the apex 204 area extending between the apex 204 and the peripheral area 202.

In an embodiment, the plurality of regions comprise four substantially regions of substantially similar size and shape surrounding the apex 204 as illustrated in FIG. 2. Each region includes a light source 104 adjacent to the perimeter of the base 102 positioned to illuminate its respective region. In another embodiment, the peripheral area 202 is substantially planar and the light tile is square.

Figure 3:
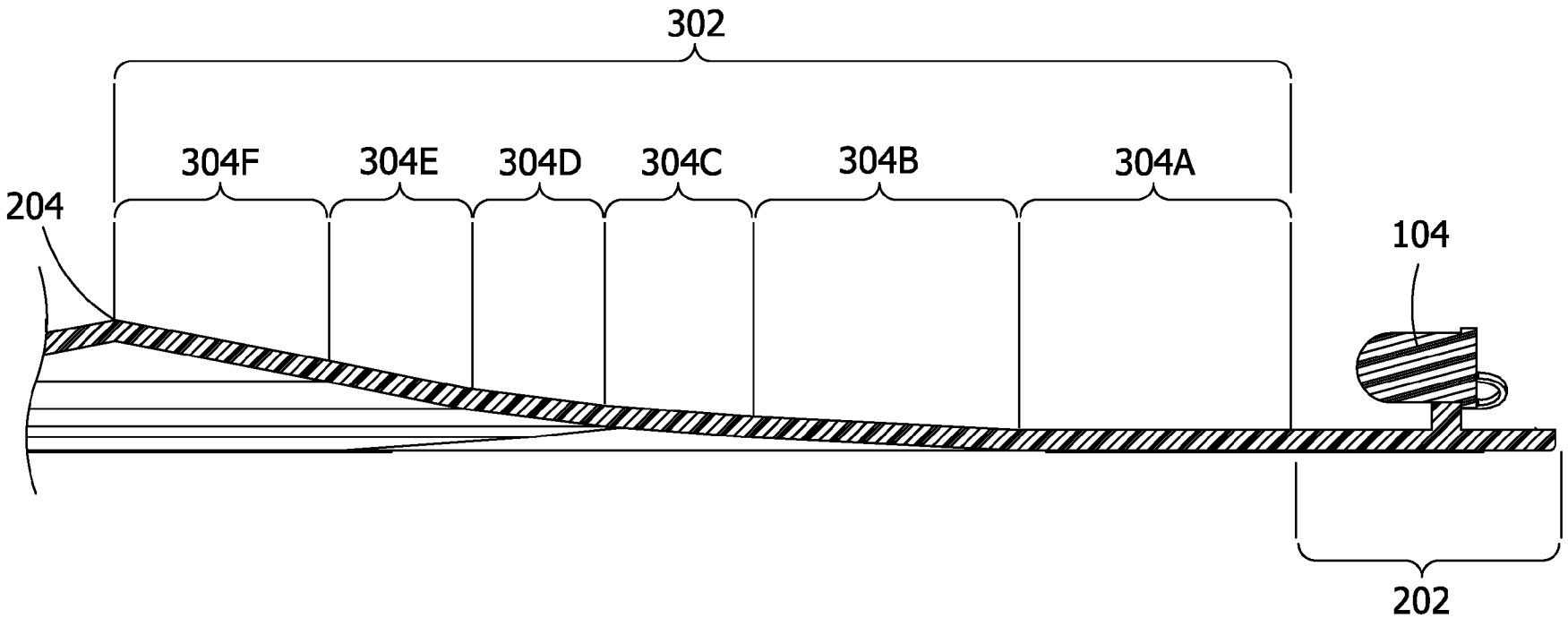
FIG. 3 is partial cross sectional view taken along lines 3-3 of FIG. 4 illustrating an embodiment of the slanted light reflecting surface of a base of a light tile of the invention.
Figure 4:
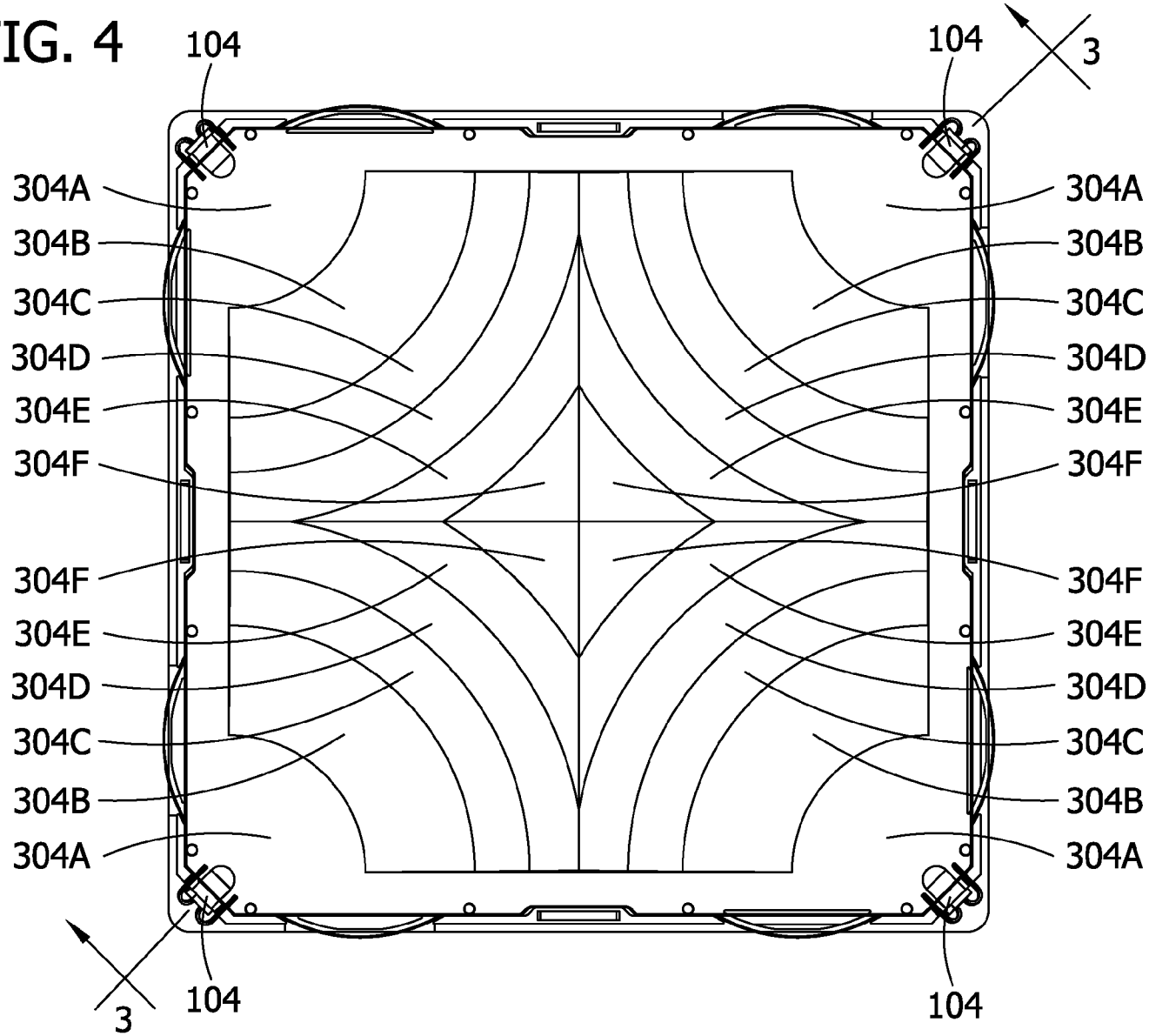
FIG. 4 is a top plan view illustrating an embodiment of a slanted light reflecting surface of a base of a light tile of the invention.

In yet another embodiment, as shown in FIG. 3, the slanted light reflecting surface area 302 is curved towards the apex 204. Alternatively, the slanted light reflecting area 302 may comprise a plurality of substantially planar faces 304A, 304B, 304C, 304D, 304E, 304F oriented at reflecting angles which increase successively towards the apex 204. In an embodiment, the face 304A nearest its respective light source 104 is substantially planar. In another embodiment, the reflecting angles of the successive faces 304A, 304B, 304C, 304D, 304E, 304F are within a range of approximately 0 degrees to 12 degrees. In yet another embodiment, shown in FIG. 4, the faces 304A, 304B, 304C, 304D, 304E, 304F of each region are curved areas defined by parallel arcs subscribed on a common origin located generally at the light source 104 for illuminating the respective region. It is also contemplated that the reflecting surface area may be substantially planar surface, although this could result in less even illumination of the surface area.

Referring again to FIG. 1, the reflecting regions of the base 102 may include a rough texture. For example, one or more regions may be coated with one or more layers of a highly reflective and diffuse paint (e.g. sphere paint) to enhance the uniform lighting of the reflective surface area of the region. Alternately, simple paint, phosphor paint, or silvered paint may be used to coat the reflecting regions of the base 102. In another embodiment, the base 102 may comprise a white ABS plastic to avoid or reduce the number of coats of paint needed to create a highly reflective front surface. Alternatively, the base 102 is textured in addition to or instead of being coated to enhance the uniform lighting of the reflective surface area of the region.

The cover 106 is adapted to be illuminated by light emitted by the light source 104 and by light from the source 104 which is reflected off the slanted light reflecting area of each region of the base 102. And, the rear surface is adapted to be mounted to a wall or other surface (see FIG. 11) and includes one or more of the following: a screw, a nail, double-faced tape 108 and removable double-faced tape.

Figure 5:
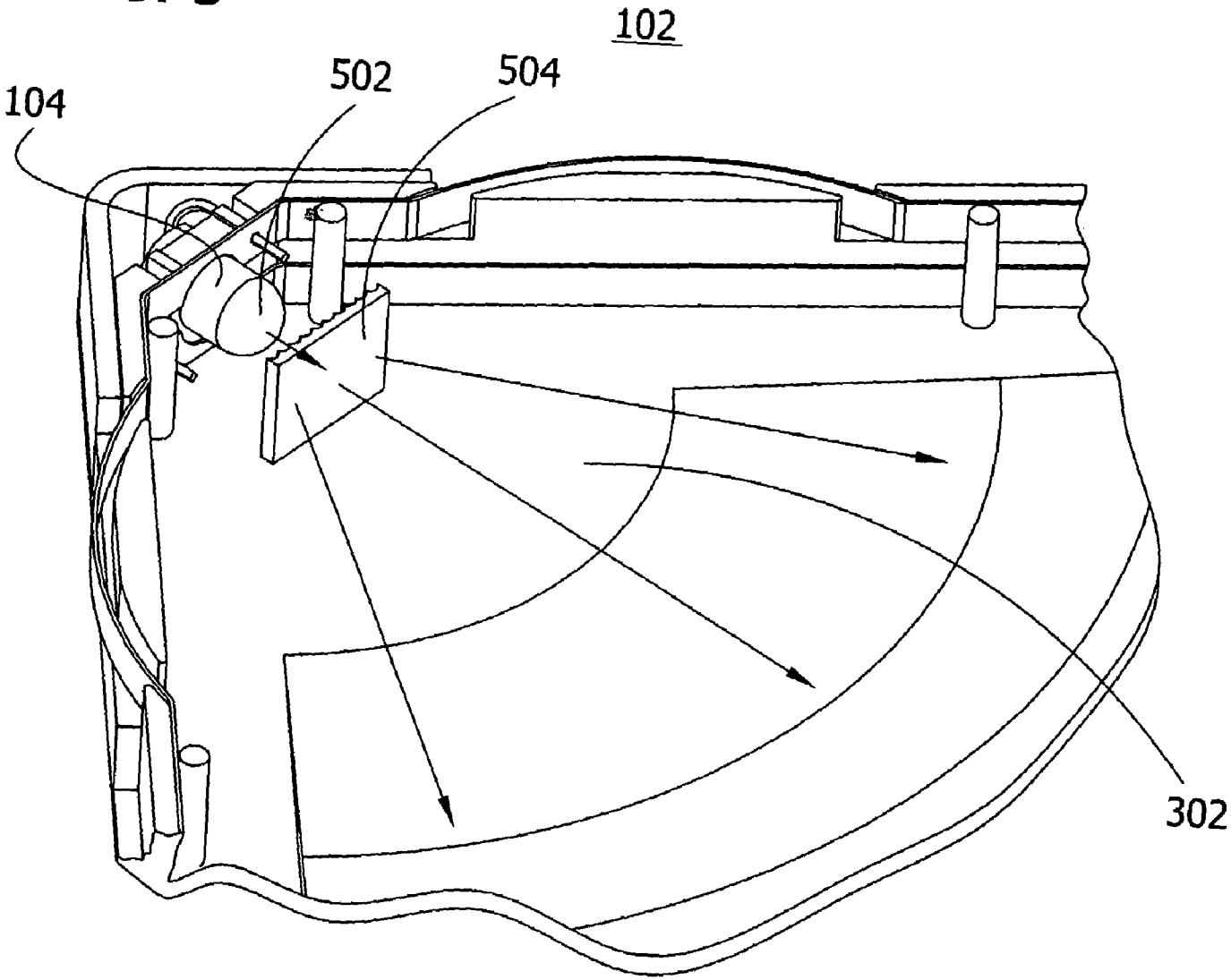
FIG. 5 is partial perspective view illustrating an embodiment of a light source and a corner of a base of the light tile of the invention.

In an embodiment illustrated in FIG. 5, the light source 104 comprises a primary lens 502 positioned adjacent to the perimeter of the base 102 between the light source 104 and a slanted light reflecting area 302. Alternatively, a secondary lens 504 may be positioned adjacent the primary lens 502 between the primary lens 502 and the slanted light reflecting area 302. The secondary lens 504 increases the angle of divergence of the light emitted by the primary lens 502 toward the slanted light reflecting area 302 and decreases the columniation of the light emitted by the primary lens 502. In an embodiment, the secondary lens 504 is molded as an integral part of the inside of the cover 106. Alternatively, the secondary lens 504 may be molded into or suitably affixed to the base 102. It is also contemplated that the secondary lens 504 may be curved and/or may be used without the primary lens 502.

Figure 6:
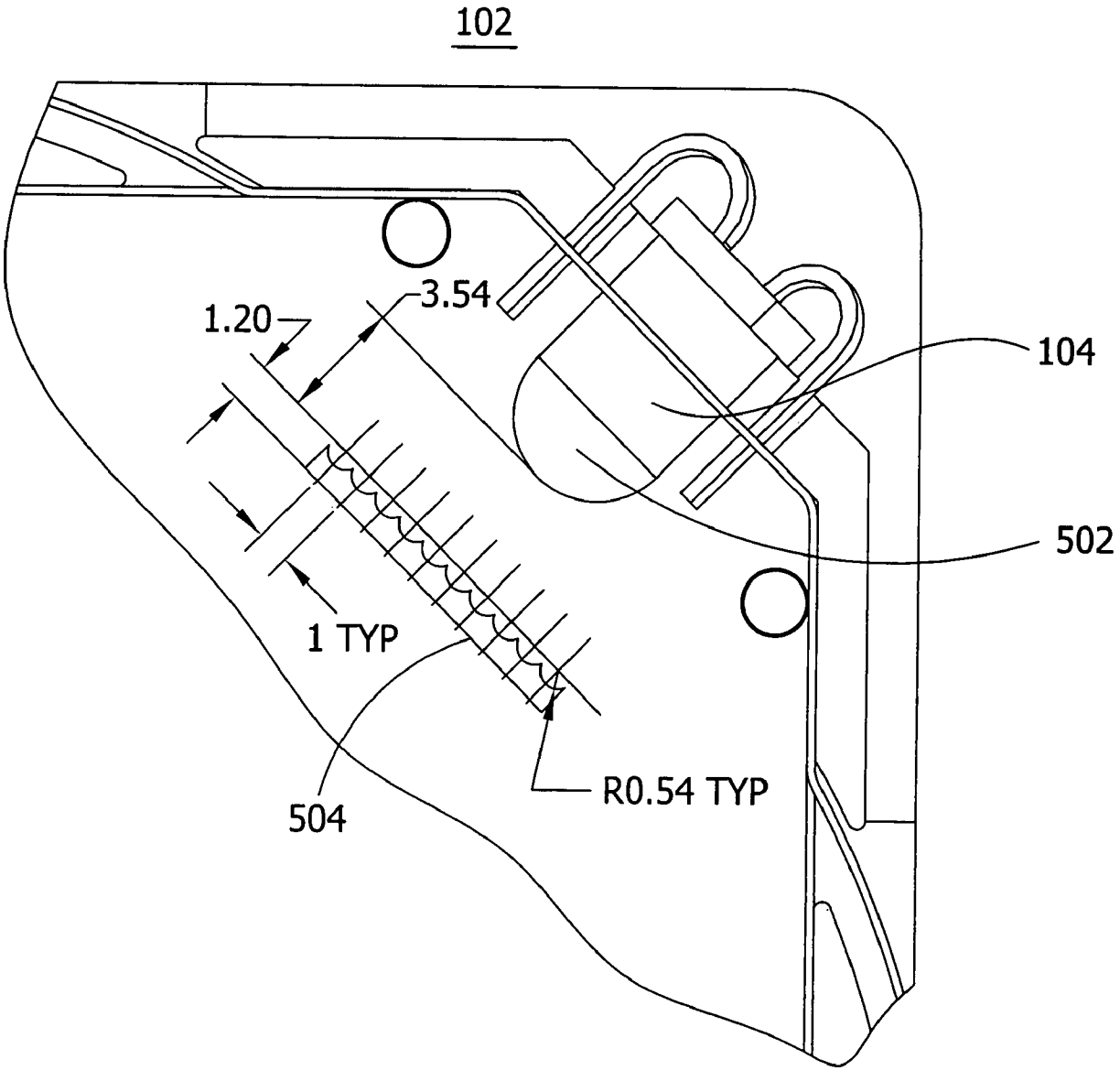
FIG. 6 is perspective top view illustrating an embodiment of a light source and a secondary lens of a light tile of the invention.

In an embodiment, the light source 104 includes one or more of the following: an LED, a plurality of LEDs, and a secondary spread lens 504. Alternatively, the light source 104 comprises a 3-color LED with an operable controller, to generate a plurality of light colors. In another alternative, the LED is a 5 mm 14,000-16,000 millicandela (mcd) white radial LED. Alternatively, the LED may be a white light LED, a three color RGB LED, a two color LED (e.g. RG, RB, GB) or a LED that emits any color available in LED format (e.g., red, green, blue, amber, ultraviolet). In another alternative, the LED may be a surface mount LED, printed circuit board pin based mount LED with or without side emitters. In an embodiment, the light source 104 emits a conical beam having an angle of divergence of approximately 7 degrees. In an embodiment, the light source 104 emits a beam light having an angle of divergence of approximately 90 degrees. One skilled in the art will recognize that other light sources or LEDs could be utilized. FIG. 6 is a detailed drawing of an embodiment of the invention including the light source 104 and the secondary lens 504.

Referring again to FIG. 1, in one embodiment, a translucent sheet 110 is positioned over the cover 106 and illuminated by light from the light source 104 and by light reflected by the slanted light reflecting area. For example, sheet 110 may be a translucent sheet comprising at least one or more of the following: a vellum sheet, a photograph, a printed sheet, a colored sheet, and a transparent sheet. Alternatively, a shield 112 is positioned over the translucent sheet 110 to hold the sheet in position on the cover 106 and to protect the sheet. In an embodiment, the shield is made from a clear polycarbonate material.

Figure 7:
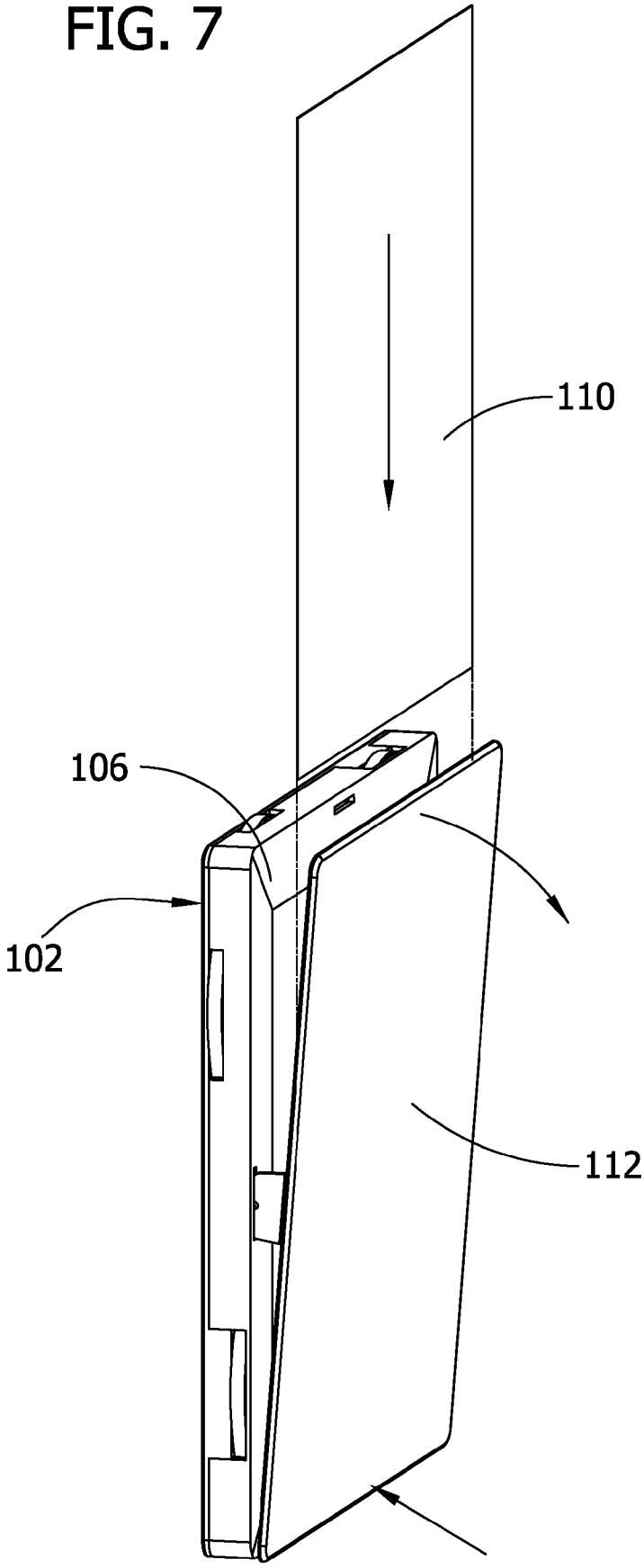
FIG. 7 is partially exploded view illustrating an embodiment of the light tile of the invention with a decorative sheet being inserted between a base and a shield.

FIG. 7 illustrates an embodiment where the shield 112 pivots about one edge connected to an edge of the cover 106. When pivoted, the shield 112 forms an angle of approximately 3 degrees with the cover 106 to create an opening allowing access in order to insert or remove the decorative sheet 110. Advantageously, the decorative sheet 110 may be customized and replaced as desired to provide unique decorating options. Furthermore, the decorative sheet 110 gives the light tile a unique illuminated and unilluminated appearance. In an embodiment, the decorative sheet 110 is approximately 13.97 centimeters (5.5 inches) square. The optional 3-color LED with an operable controller noted above may be utilized alone or in conjunction with the decorative sheet 110.

Figure 8:
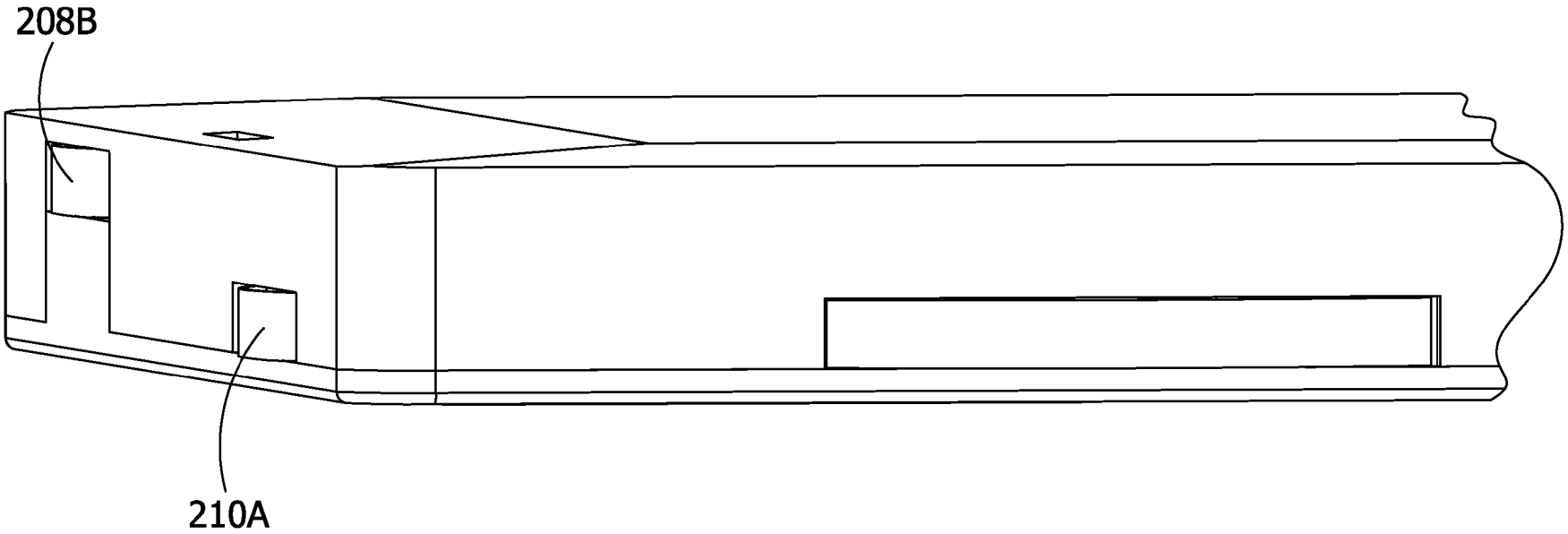
FIG. 8 is perspective side view illustrating an embodiment of the light tile of the invention with a bus bar system.

Referring again to FIG. 1, in an embodiment, the light tile includes a bus bar system positioned along a perimeter of the light tile. The bus bar is electrically connected to the one or more light sources 104 and provides a circuit for supplying power to the light source(s) 104. The bus bar system includes a positive bus bar 114 and a negative bus bar 116 positioned at different elevations from the front surface of the light tile. One skilled in the art will recognize that the relative positions of the positive bus bar 114 and the negative bus bar 116 may be reversed without departing from the scope of the invention. FIG. 8 illustrates an embodiment where a negative contact 210A of the negative bus bar 116 is at a lower elevation from the front surface of the light tile than a positive contact 208B of the positive bus bar 114. This assures that the polarity of each bus bar only touches its matching polarity on any adjoining tile. In an embodiment, the positive and negative bus bars are the same stamping and are manufactured from tin plated beryllium copper, approximately 0.25 mm thick.

In another embodiment, shown in FIG. 2, the light tile is rectangular and the positive bus bar 114 has two contact areas 206A, 206B adjacent to a first corner of the light tile and two additional contact areas 208A, 208B adjacent to a second corner of the light tile. One contact is positioned on each side of each corner. The first corner is located diagonally across from the second corner. Additionally, the negative bus bar 116 has two contact areas 210A, 210B adjacent to a third corner of the light tile, with one contact on each side of the third corner. Two additional contact areas (not shown) are adjacent to a fourth corner of the light tile, with one contact on each side of the fourth corner. The third corner is located diagonally across from the fourth corner. This configuration of the contact areas allows any one tile to be positioned adjacent to any other tile with the result that the bus bar systems of the tile will be electrically connected to each other with the proper polarity, i.e., the positive bus bar of the one tile will connect to the positive bus bar of the other tile and the negative bus bar of the one tile will connect to the negative bus bar of the other tile.

Figure 9:
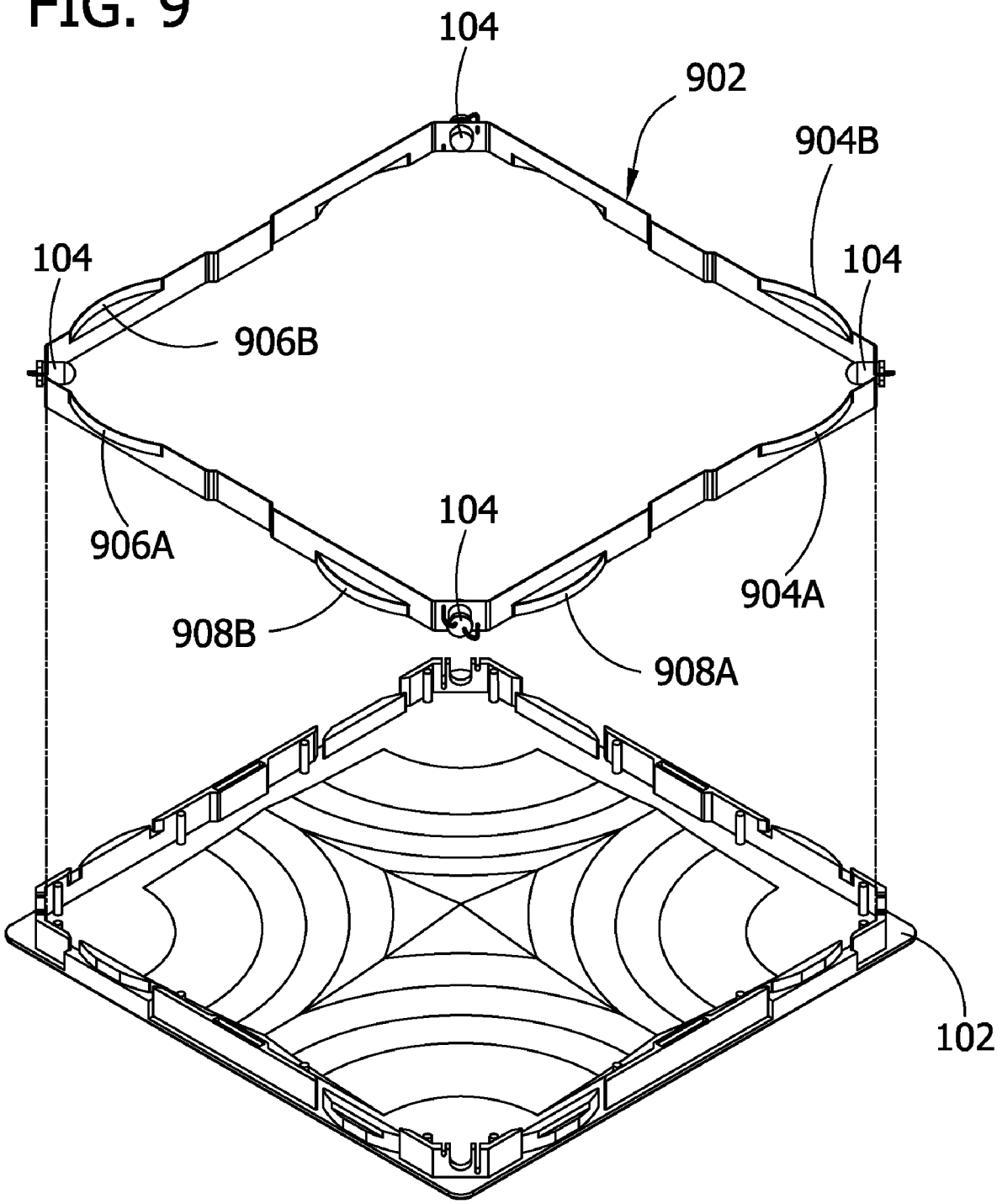
FIG. 9 is an exploded view illustrating an embodiment of the light tile of the invention with a flex circuit.

In one embodiment, shown in FIG. 9, the light tile includes a flex circuit system 902 positioned along a perimeter of the base 102 of the light tile. The flex circuit is a flexible version of Printed Circuit Board (PCB), and offers the same advantages of a printed circuit board: repeatability, reliability, and high density with the added advantages of flexibility and vibration resistance. The flex circuit system 902 is electrically connected to the light source 104 and provides a circuit for supplying power to the light source 104. The flex circuit system 902 includes at least one positive contact and at least one negative contact, the positive and negative contacts being positioned at different elevations from the front surface of the light tile.

In another embodiment, the light tile is rectangular and the flex circuit system 902 has two positive contact areas 904A, 904B adjacent to a first corner of the light tile, one positive contact on each side of said first corner and two additional positive contact areas 906A, 906B adjacent to a second corner of the light tile, one positive contact on each side of the second corner. The first corner is located diagonally across from the second corner. Also, in this embodiment, the flex circuit system 902 has two negative contact areas 908A, 908B adjacent to a third corner of the light tile, one negative contact on each side of said third corner and two negative contact areas (not shown) adjacent to a fourth corner of the light tile, one negative contact on each side of said fourth corner. The third corner is located diagonally across from the fourth corner.

Figure 10:
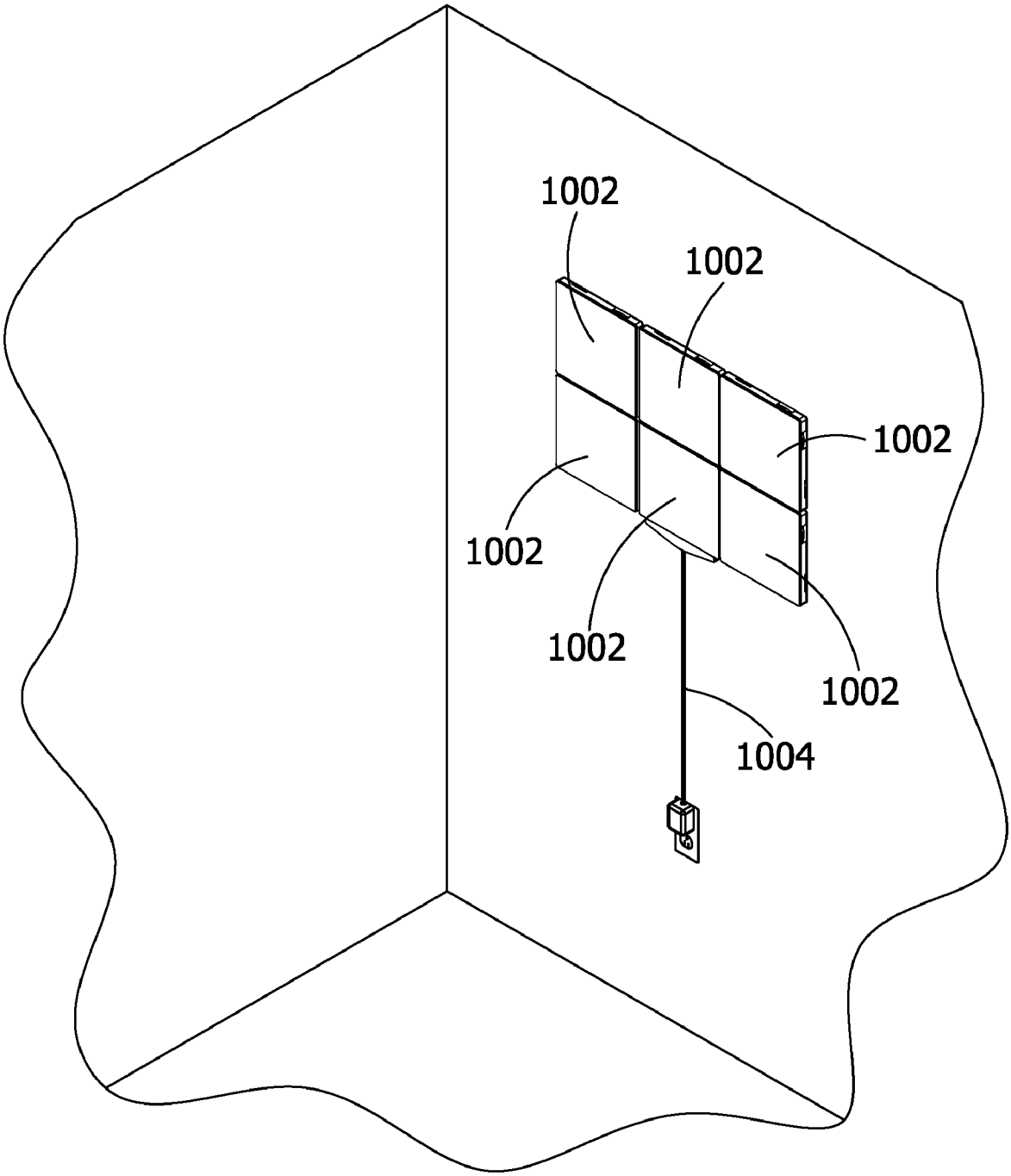
FIG. 10 is an exemplary diagram illustrating an embodiment of a system of the invention of a plurality of light tiles.

FIG. 10 illustrates a light tile system comprising a plurality of light tiles 1002 positioned adjacent to each other, with one of the tiles positioned adjacent to a power supply 1004. Each light tile 1002 has a bus bar system connected to a light source 104 within the light tile, the light tiles positioned contiguous to each other so that the bus bar systems are in electrical contact with each other. In an embodiment, the light source 104 includes an electrical constant current driver to regulate the current through the light source 104 regardless of power supply variations or changes in forward voltage drops between light sources 104. Additionally, the electrical constant current driver assures that each tile is lit equally, regardless of its relative position to the power supply 1004. In another embodiment, the light tiles 1002 include double-faced tape (not shown) on the rear surface of the tile for mounting the light tiles 1002 and power supply 1004 onto a wall or other surface such that the light tiles 1002 are held in place on the wall and maintain electrical contact with each other and the power supply 1004. In yet another embodiment, the light tiles 1002 will include a latch molded into the base of each light tile connecting each tile to any adjoining light tile to assure electrical alignment and connection.

The power supply 1004 (shown in detail in FIG. 11) includes a power bus 1108 compatible with the light tiles 1002. In an embodiment, the power bus 1108 includes two tin plated beryllium copper bus bars, approximately 0.25 mm thick.

The power supply 1004 is positioned so that its power bus 1208 connects to one of the bus bar systems of one of the light tiles 1002 for supplying power to the one bus bar system and to the other bus bar systems in electrical contact with the one bus bar system.

Figure 11:
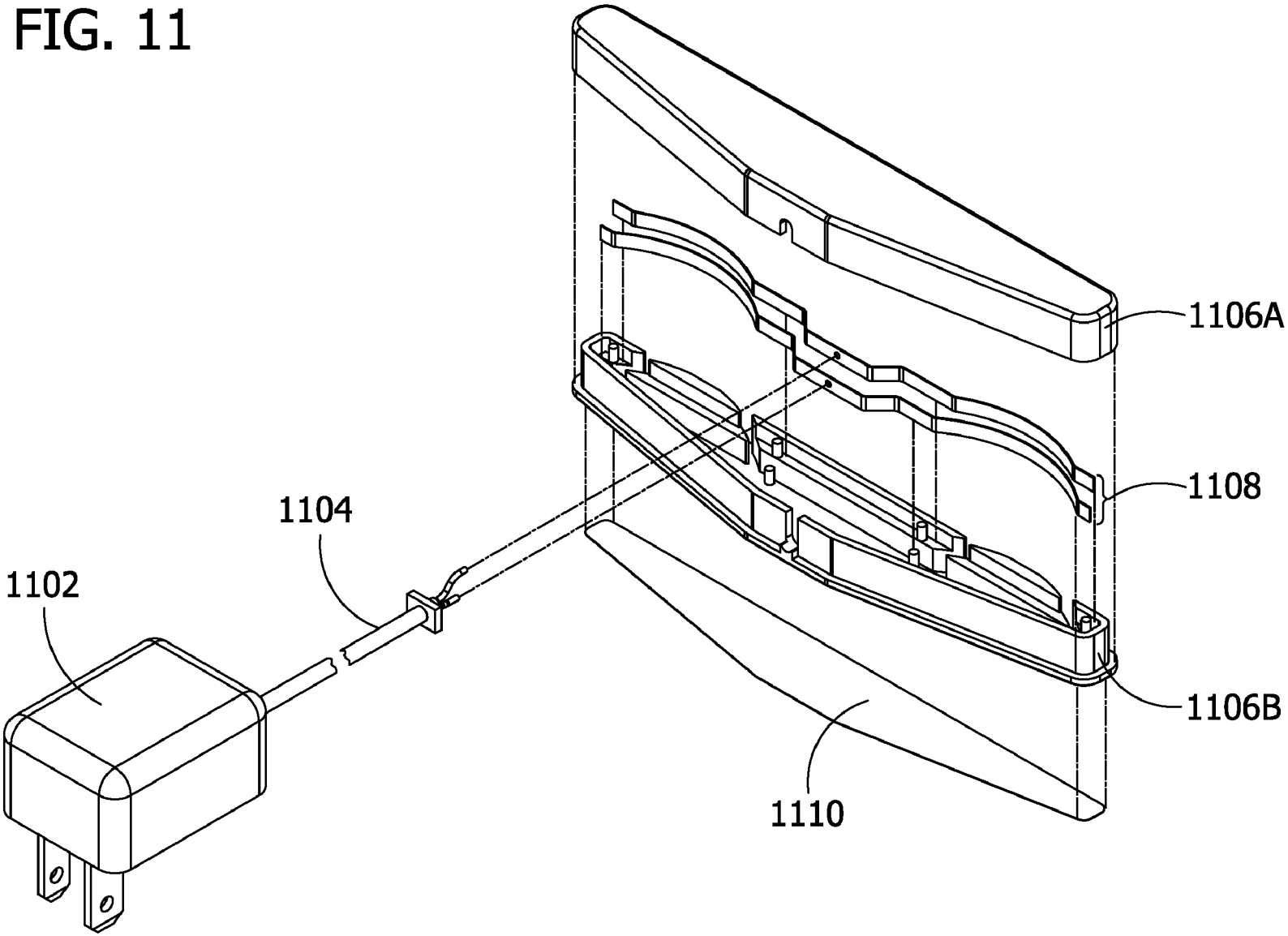
FIG. 11 is an exploded view illustrating an embodiment of a power supply of a light tile of the invention.
Figure 12:
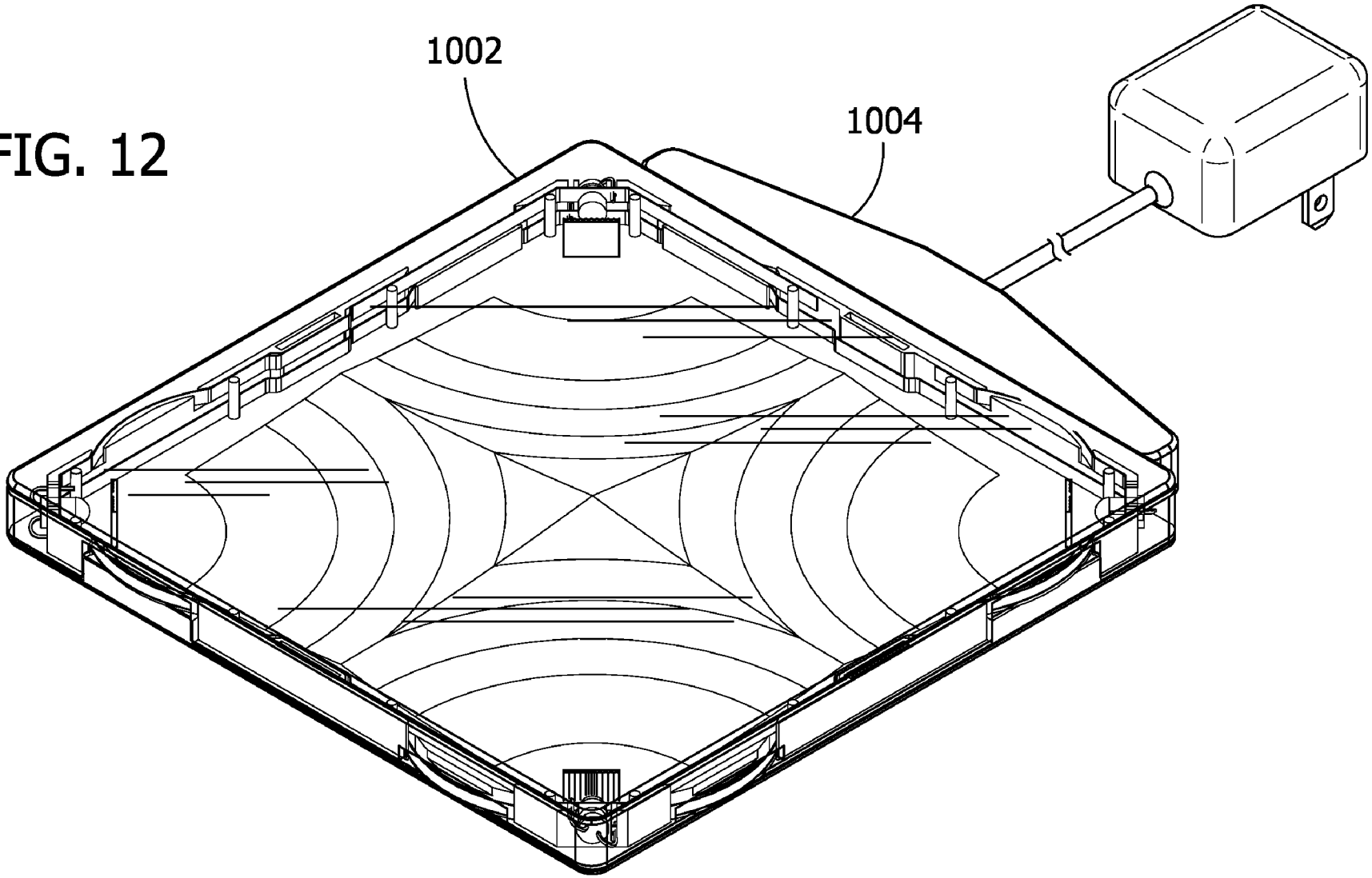
FIG. 12 is an exemplary diagram illustrating an embodiment of a power supply of the light tile of the invention.

In one embodiment shown in FIG. 11, the power supply includes a converter 1102, a power cord 1104, a housing 1106A, 1106B, a power bus 1108 and a double-faced tape strip 1110. In an embodiment, the power supply includes a 100V to 3.5V power converter 1102 and 10 foot low voltage (3.5V) power cord 1104. In an embodiment, the power bus 1108 includes positive and negative contacts arranged to engage any side of any light tile 1002 such as illustrated in FIG. 12.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

What is claimed is:

1. A light tile comprising:

a base comprising a rear surface adapted to be placed on a support surface; and a front surface comprising:

a peripheral area adjacent to an outer perimeter of the base;

an apex elevated in relation to the peripheral area; and a slanted light reflecting area surrounding the apex and comprising at least three regions defining the apex extending between the peripheral area and the apex;

at least three light sources adjacent to the perimeter of the base positioned to illuminate at least the slanted light reflecting area of the base, the light sources being arranged to direct light along at least three different directions;

each of said at least three regions of the slanted light reflecting area facing a different direction and having a respective said light source positioned to illuminate said corresponding region; and a cover mounted on the base adapted to be illuminated by light from the light sources reflected off the slanted light reflecting area.

2. The light tile of claim 1, wherein the rear surface is adapted to mounted to a wall and includes one or more of the following: a screw, a nail, double-faced tape and removable double-faced tape.

3. The light tile of claim 1, wherein the apex is located generally at the center of the base.

4. The light tile of claim 1, wherein four substantially equal regions surrounding surround the apex.

5. The light tile of claim 1, wherein the slanted light reflecting area is curved towards the apex.

6. The light tile of claim 1, wherein the slanted light reflecting area comprises a plurality of faces, the faces being oriented at reflecting angles which increase successively towards the apex.

7. The light tile of claim 6, wherein the faces are curved on arcs centered generally at a respective light source.

8. The light tile of claim 6, wherein the face nearest the respective light source is substantially planar.

9. The light tile of claim 6, wherein the reflecting angles of the successive faces are within a range of approximately 0 degrees to 12 degrees.

10. The light tile of claim 1, wherein the peripheral area is substantially planar and wherein the light tile is square.

11. The light tile of claim 1, at least one said light source further comprising:

a primary lens positioned adjacent to the perimeter of the base between the light source and the slanted light reflecting area; and a secondary lens positioned adjacent the primary lens between the primary lens and the slanted light reflecting area increasing the angle of divergence of the light transmitted by the primary lens toward the slanted light reflecting area and decreasing the vertical columniation of the light transmitted by the primary lens.

12. The light tile of claim 1, wherein at least one said light source includes one or more of the following: an LED and a secondary spread lens.

13. The light tile of claim 1, wherein at least one said light source emits a conical beam having an angle of divergence of approximately 7 degrees.

14. The light tile of claim 1, wherein at least one said light source emits a light beam having an angle of divergence of approximately 90 degrees.

15. The light tile of claim 1, wherein at least one said light source comprises a 3-color LED with an operable controller to generate a plurality of light colors, wherein the light tile is rectangular and the a least three light sources comprises four light sources positioned near respective corners of the slanted light reflecting area, and wherein the cover is translucent.

16. The light tile of claim 1, further comprising a translucent sheet positioned over the cover and illuminated by light from the light sources reflected by the slanted light reflecting area.

17. The light tile of claim 16, wherein the translucent sheet comprises at least one of the following: a vellum sheet, a photograph, a printed sheet, a colored sheet, and a transparent sheet.

18. The light tile of claim 16, further comprising a shield positioned over the translucent sheet.

19. A light tile comprising:

a base comprising a rear surface adapted to be placed on a support surface; and a front surface comprising:

a peripheral area adjacent to an outer perimeter of the base;

an apex elevated in relation to the peripheral area; and a slanted light reflecting area between the peripheral area and the apex;

at least one light source adjacent to the perimeter of the base positioned to illuminate at least the slanted light reflecting area of the base;

a cover mounted on the base adapted to be illuminated by light from the at least one light source reflected off the slanted light reflecting area; and a flex circuit system positioned along a perimeter of the light tile, said flex circuit system being electrically connected to the at least one light source and providing a circuit for supplying power to the at least one light source.

20. The light tile of claim 19, wherein the flex circuit system includes at least one positive contact and at least one negative contact, the positive and negative contacts being positioned at different elevations from the front surface of the light tile.

21. The light tile of 19, wherein the light tile is rectangular;

wherein the flex circuit system has two positive contact areas adjacent to a first corner of the light tile, one positive contact on each side of said first corner, two positive contact areas adjacent to a second corner of the light tile, one positive contact on each side of said second corner, said first corner being located diagonally across from the second corner; and wherein the flex circuit system has two negative contact areas adjacent to a third corner of the light tile, one negative contact on each side of said third corner, two negative contact areas adjacent to a fourth corner of the light tile, one negative contact on each side of said fourth corner, said third corner being located diagonally across from the fourth corner.

22. A light tile comprising:

a base comprising a rear surface adapted to be placed on a support surface; and a front surface comprising:

a peripheral area adjacent to an outer perimeter of the base;

an apex elevated in relation to the peripheral area; and a slanted light reflecting area between the peripheral area and the apex;

at least one light source adjacent to the perimeter of the base positioned to illuminate at least the slanted light reflecting area of the base;

a cover mounted on the base adapted to be illuminated by light from the at least one light source reflected off the slanted light reflecting area; and a bus bar system positioned along a perimeter of the light tile, said bus bar being electrically connected to the at least one light source and providing a circuit for supplying power to the at least one light source.

23. The light tile of claim 22, wherein the bus bar system comprises a positive bus bar and a negative bus bar, the positive and negative bus bars being positioned at different elevations from the front surface of the light tile.

24. The light tile of 22, wherein the light tile is rectangular;

wherein the positive bus bar has two contact areas adjacent to a first corner of the light tile, one contact on each side of said first corner, two contact areas adjacent to a second corner of the light tile, one contact on each side of said second corner, said first corner being located diagonally across from the second corner; and wherein the negative bus bar has two contact areas adjacent to a third corner of the light tile, one contact on each side of said third corner, two contact areas adjacent to a fourth corner of the light tile, one contact on each side of said fourth corner, said third corner being located diagonally across from the fourth corner.

25. A light tile system comprising:

a plurality of light tiles, each light tile having a bus bar system connected to a light source within the light tile, such that with the light tiles positioned contiguous to each other the bus bar systems of neighboring light tiles are in electrical contact with each other;

a decorative sheet positioned adjacent to each light tile and illuminated by the light source within the light tile; and a power supply having a power bus connecting to one of the bus bar systems of one of the light tiles for supplying power to the one bus bar system and to the other bus bar systems in electrical contact with the one bus bar system.

26. The light tile system of claim 25, wherein each light tile comprises:

a base comprising a rear surface adapted to be placed on a support surface; and a front surface comprising:

a peripheral area adjacent to an outer perimeter of the base;

an apex elevated in relation to the peripheral area; and a slanted light reflecting area between the peripheral area and the apex;

at least one light source adjacent to the perimeter of the base positioned to illuminate the slanted light reflecting area; and a cover mounted on the base being adapted to be illuminated by light from the at least one light source reflected off the slanted light reflecting area.

27. The light tile system of claim 25, wherein the bus system comprises a positive bus bar and a negative bus bar, the positive and negative bus bars being positioned at different elevations from the front surface of the base.

28. The light tile system of 27, wherein the light tile is rectangular;

wherein the positive bus bar has two contact areas adjacent to a first corner of the light tile, one contact on each side of said first corner, two contact areas adjacent to a second corner of the light tile, one contact on each side of said second corner, said first corner being located diagonally across from the second corner; and wherein the negative bus bar has two contact areas adjacent to a third corner of light tile, one contact on each side of said third corner, two contact areas adjacent to a fourth corner of the light tile, one contact on each side of said fourth corner, said third corner being located diagonally across from the fourth corner.

29. The light tile system of claim 25, wherein the at least one light source includes one or more of the following: an LED, a plurality of LEDs, a secondary spread lens and a 3-color LED with a controller to generate a plurality of light colors.

30. The light tile system of claim 25, wherein the decorative sheet comprises at least one of the following: a vellum sheet, a photograph, a printed sheet, a colored sheet, and a transparent sheet.

31. A light tile comprising:

at least one light source on the light tile to illuminate the light tile; and a bus bar system positioned along a perimeter of a light tile electrically connecting the at least one light source and providing a circuit for supplying power to the at least one light source comprising:

a positive bus bar; and a negative bus bar, wherein the positive and negative bus bars being positioned at different horizontal elevations along the sides of the light tile.

32. The bus bar of claim 31, wherein the light tile is rectangular;

wherein the positive bus bar has two contact areas adjacent to a first corner of the light tile, one contact on each side of said first corner, two contact areas adjacent to a second corner of the light tile, one contact on each side of said second corner, said first corner being located diagonally across from the second corner; and wherein the negative bus bar has two contact areas adjacent to a third corner of the light tile, one contact on each side of said third corner, two contact areas adjacent to a fourth corner of the light tile, one contact on each side of said fourth corner, said third corner being located diagonally across from the fourth corner.

* * * * *